US011456561B2

(12) United States Patent
Guo et al.

(10) Patent No.: US 11,456,561 B2
(45) Date of Patent: Sep. 27, 2022

(54) TERMINAL STRUCTURE FOR HIGH-SPEED DATA TRANSMISSION CONNECTOR AND CONNECTOR THEREOF

(71) Applicant: Dongguan Luxshare Technologies Co., Ltd, Dongguan (CN)

(72) Inventors: Rongzhe Guo, Dongguan (CN); Kechang Wei, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 72 days.

(21) Appl. No.: 17/209,760

(22) Filed: Mar. 23, 2021

(65) Prior Publication Data

US 2021/0359468 A1 Nov. 18, 2021

(30) Foreign Application Priority Data

May 18, 2020 (CN) ..... 202010418536.0

(51) Int. Cl.
*H01R 13/40* (2006.01)
*H01R 13/6471* (2011.01)
(Continued)

(52) U.S. Cl.
CPC ..... *H01R 13/6471* (2013.01); *H01R 13/40* (2013.01); *H01R 13/502* (2013.01); *H01R 13/516* (2013.01); *H01R 13/6591* (2013.01)

(58) Field of Classification Search
CPC .. H01R 24/64; H01R 12/724; H01R 13/6582; H01R 12/57; H01R 12/716; H01R 13/6461; H01R 24/60; H01R 4/2429
See application file for complete search history.

(56) References Cited

U.S. PATENT DOCUMENTS 4,196,957 A * 4/1980 Benasutti ..... H01R 12/727 439/682
4,583,807 A * 4/1986 Kaufman ..... H01R 12/724 439/573
(Continued)

FOREIGN PATENT DOCUMENTS

CN 202013961 A 10/2011
CN 103250306 A 8/2013
(Continued)

*Primary Examiner* — Truc T Nguyen
(74) *Attorney, Agent, or Firm* — Birch, Stewart, Kolasch & Birch, LLP

(57) ABSTRACT

The invention is applicable to the technical field of connectors, and in particular, relates to a terminal structure for a high-speed data transmission connector and a connector thereof. The terminal structure for a high-speed data transmission connector comprises an upper row terminal and a lower row terminal respectively assembled at an upper end and a lower end of an insulating body of the high-speed data transmission connector, and electrically connected to a PCB motherboard of the high-speed data transmission connector, the upper row terminal comprising a front-end terminal and a rear-end terminal connected to each other, and the terminal structure further comprises: a first anti-resonance module comprising a first conducting member disposed on the front-end terminal; and a second anti-resonance module comprising a second conducting member disposed on the rear-end terminal; wherein an exterior angle at connection of the front-end terminal and the rear-end terminal is from 55° to 80°. In view of this, the application improves anti-resonance effect of the terminal structure and the connector.

25 Claims, 7 Drawing Sheets

(51) Int. Cl.

| | |
|---|---|
| ***H01R 13/502*** | (2006.01) |
| ***H01R 13/516*** | (2006.01) |
| ***H01R 13/6591*** | (2011.01) |

(56) References Cited

U.S. PATENT DOCUMENTS

| | | | | |
|---|---|---|---|---|
| 8,491,313 | B2 | 7/2013 | McNamara et al. | |
| 9,209,573 | B1 * | 12/2015 | Chen | H01R 13/6581 |
| 9,515,438 | B1 * | 12/2016 | Chang | H01R 13/6474 |
| 9,979,136 | B1 * | 5/2018 | Wu | H01R 13/6597 |
| 11,251,558 | B1 * | 2/2022 | Lee | H01R 13/6599 |
| 2015/0340791 | A1 * | 11/2015 | Kao | H01R 13/6474 439/676 |
| 2017/0365954 | A1 * | 12/2017 | Chen | H01R 24/60 |

FOREIGN PATENT DOCUMENTS

| | | | |
|---|---|---|---|
| CN | 107069281 | A | 8/2017 |
| CN | 107069304 | A | 8/2017 |
| CN | 107123902 | A | 9/2017 |
| CN | 208240996 | U | 12/2018 |
| CN | 109314334 | A | 2/2019 |
| CN | 109390803 | A | 2/2019 |
| CN | 109546379 | A | 3/2019 |
| CN | 109728453 | A | 5/2019 |
| CN | 208970853 | U | 6/2019 |
| CN | 106025718 | B | 2/2020 |
| TW | M528532 | U | 9/2016 |

* cited by examiner

TERMINAL STRUCTURE FOR HIGH-SPEED DATA TRANSMISSION CONNECTOR AND CONNECTOR THEREOF

BACKGROUND OF THE INVENTION

1. Field of the Invention

The invention relates to the technical field of connectors, and particularly to a terminal structure for a high-speed data transmission connector and a connector thereof.

2. Related Art

With respect to the requirements for high performance and high bandwidth system, the requirement for performance of a high-speed data transmission connector is increasing, but the following problems still exist in manufacture of the high-speed data transmission connector. 1. The high-speed data transmission connector has poor anti-resonance effect; 2. Currently, when insertion molding of components such as a terminal and a plastic core of the high-speed data transmission connector is in the lower row terminal, running slider occurs, so it is not suitable for efficient and rapid molding of vertical injection molding machines; 3. Currently, strip connection of the terminal of the high-speed data transmission connector does not facilitate continuous and selective electrogilding; 4. Currently, placement and transportation of the insertion molding of the terminal and the plastic core of the high-speed data transmission connector easily cause deformation of the terminal; 5. Currently, the insertion molding of the terminal and the plastic core of the high-speed data transmission connector must bend twice in assembly, causing a difference of coplanarity of Surface Mounted Technology (SMT) solder tails.

In the prior art, for example, the Chinese patent application with the application No. 201820869724.3 and the title QSFP high-speed signal electric connector discloses a QSFP high-speed signal electric connector, which connects ground Ps on both sides of a signal pair together using six legs of elastic sheets by building an elastic sheet structure outside first and second modules to form an enclosed electromagnetic field space, so as to improve anti-crosstalk capability, solve the problem of resonance generated by crosstalk at distal and proximate ends, and satisfy transmission performance of the high-speed connector. Moreover, the elastic sheets are in elastic contact with ground terminals, and the elastic sheets have an abutting pressure towards the ground terminals, while both sides grab the insulating body for fixing, such that contact is more firmly, so as not easily cause poor contact due to slight vibration and deformation. The solution aims at an electric connector with QSFP28 single channel transmission speed 25 Gpbs, which improves high-speed signal transmission capability. However, the structure is complicated, the anti-resonance effect is poor, and it is difficult to solve the problems of running slider, and deformation of the terminal easily caused in transportation when insertion molding of the terminal and the plastic core is in the lower row terminal.

To sum up, the prior art obviously has inconveniences and deficiencies in practical use, so it is necessary to make improvement.

SUMMARY OF THE INVENTION

With respect to the above deficiencies, an object of the invention is to provide a terminal structure for a high-speed data transmission connector and a connector thereof, so as to improve anti-resonance effect of the terminal structure and the connector.

To realize the above object, the invention provides a terminal structure for a high-speed data transmission connector, comprising an upper row terminal and a lower row terminal respectively assembled at an upper end and a lower end of an insulating body of the high-speed data transmission connector, and electrically connected to a PCB motherboard of the high-speed data transmission connector, the upper row terminal comprising a front-end terminal and a rear-end terminal connected to each other, the terminal structure further comprising:

a first anti-resonance module comprising a first conducting member disposed on the front-end terminal; and a second anti-resonance module comprising a second conducting member disposed on the rear-end terminal;

wherein an exterior angle at connection of the front-end terminal and the rear-end terminal is from 55° to 80°.

According to the terminal structure, the first anti-resonance module further comprises:

a first insulation embedded block on which a first mounting part for mounting the first conducting member and a first fixing part for fixing the first insulation embedded block on the front-end terminal are provided;

the second anti-resonance module further comprises:

a second insulation embedded block on which a second mounting part for mounting the second conducting member and a second fixing part for fixing the second insulation embedded block on the rear-end terminal are provided.

According to the terminal structure, the first conducting member is a first metal sheet or a first conducting film; the first mounting part is a first mounting groove provided on an upper part of the first insulation embedded block; the first fixing part is a plurality of first through holes provided in a middle part of the first insulation embedded block and matched with the front-end terminal;

the second conducting member is a second metal sheet or a second conducting film; the second mounting part is a second mounting groove provided on an upper part of the second insulation embedded block; the second fixing part is a plurality of second through holes provided in a middle part of the second insulation embedded block and matched with the rear-end terminal.

According to the terminal structure, the front-end terminal and the rear-end terminal both comprise a first rear side part, a first middle part and a first head-end part, wherein the first head-end part of the front-end terminal is connected to the first head-end part of the rear-end terminal;

the first insulation embedded block is fixed on the first head-end part of the front-end terminal; the second insulation embedded block is fixed on the first middle part of the rear-end terminal.

According to the terminal structure, the first insulation embedded block and the second insulation embedded block are molded with plastic inserts of the upper row terminal;

the first rear side part of the front-end terminal is electrically connected to the PCB motherboard.

According to the terminal structure, the lower row terminal comprises a second rear side part, a second middle part and a second head-end part; the second head-end part is bent in a "C" shape, and Surface Mounted Technology (SMT) solder legs are provided at bottom of a "C"-shaped bending region of the second head-end part.

According to the terminal structure, the bending region of the solder legs has a pierced structure;

the second rear side part of the lower row terminal is electrically connected to the PCB motherboard.

According to the terminal structure, the lower row terminal is provided with a plurality of hangnail structures.

According to the terminal structure, the lower row terminal comprises a first signal transmission terminal on which a first hangnail structure is provided, and a second signal transmission terminal on which a second hangnail structure is provided, the first hangnail structure and the second hangnail structure alternated with each other.

According to the terminal structure, the first signal transmission terminal is a ground signal transmission terminal; the second signal transmission terminal is a differential signal transmission terminal;

the ground signal transmission terminal is spaced apart from the differential signal transmission terminal.

To realize another object of the invention, the invention further provides a high-speed data transmission connector, comprising a first housing, an insulating body, a PCB motherboard and a terminal structure assembled within the insulating body, the terminal structure comprising an upper row terminal and a lower row terminal, the upper row terminal comprising a front-end terminal and a rear-end terminal connected to each other, wherein the terminal structure further comprises:

a first anti-resonance module comprising a first conducting member disposed on the front-end terminal; and a second anti-resonance module comprising a second conducting member disposed on the rear-end terminal;

wherein an exterior angle at connection of the front-end terminal and the rear-end terminal is from 55° to 80°.

According to the high-speed data transmission connector, the first anti-resonance module further comprises:

a first insulation embedded block on which a first mounting part for mounting the first conducting member and a first fixing part for fixing the first insulation embedded block on the front-end terminal are provided;

the second anti-resonance module further comprises:

a second insulation embedded block on which a second mounting part for mounting the second conducting member and a second fixing part for fixing the second insulation embedded block on the rear-end terminal are provided.

According to the high-speed data transmission connector, the first conducting member is a first metal sheet or a first conducting film; the first mounting part is a first mounting groove provided on an upper part of the first insulation embedded block; the first fixing part is a plurality of first through holes provided in a middle part of the first insulation embedded block and matched with the front-end terminal;

the second conducting member is a second metal sheet or a second conducting film; the second mounting part is a second mounting groove provided on an upper part of the second insulation embedded block; the second fixing part is a plurality of second through holes provided in a middle part of the second insulation embedded block and matched with the rear-end terminal.

According to the high-speed data transmission connector, the front-end terminal and the rear-end terminal both comprise a first rear side part, a first middle part and a first head-end part, wherein the first head-end part of the front-end terminal is connected to the first head-end part of the rear-end terminal;

the first insulation embedded block is fixed on the first head-end part of the front-end terminal; the second insulation embedded block is fixed on the first middle part of the rear-end terminal.

According to the high-speed data transmission connector, the first insulation embedded block and the second insulation embedded block are molded with plastic inserts of the upper row terminal;

the first rear side part of the front-end terminal is electrically connected to the main board.

According to the high-speed data transmission connector, the lower row terminal comprises a second rear side part, a second middle part and a second head-end part; the second head-end part is bent in a "C" shape, and Surface Mounted Technology (SMT) solder legs are provided at bottom of a "C"-shaped bending region of the second head-end part.

According to the high-speed data transmission connector, the bending region of the solder legs has a pierced structure;

the second rear side part of the lower row terminal is electrically connected to the PCB motherboard.

According to the high-speed data transmission connector, the lower row terminal is provided with a plurality of hangnail structures.

According to the high-speed data transmission connector, the lower row terminal comprises a first signal transmission terminal on which a first hangnail structure is provided, and a second signal transmission terminal on which a second hangnail structure is provided, the first hangnail structure and the second hangnail structure alternated with each other.

According to the high-speed data transmission connector, the first signal transmission terminal is a ground signal transmission terminal; the second signal transmission terminal is a differential signal transmission terminal;

the ground signal transmission terminal is spaced apart from the differential signal transmission terminal.

According to the high-speed data transmission connector, first protrusions are provided on left and right sides of the first insulation embedded block, first slots matched with the first protrusions are provided on an inner side of the insulating body, and the first insulation embedded block is clamped in the first slots through the first protrusions;

second protrusions are provided on left and right sides of the second insulation embedded block, second slots matched with the second protrusions are provided on the inner side of the insulating body, and the second insulation embedded block is clamped in the second slots through the second protrusions.

According to the high-speed data transmission connector, the first insulation embedded block and the second insulation embedded block have preset spaces movable in the same direction after being clamped in the first slots and the second slots, respectively.

According to the high-speed data transmission connector, the first protrusions are a cantilever upside-down hanging structure, and the preset spaces movable in the same direction move up and down for a preset distance along a longitudinal direction of the first slots.

According to the high-speed data transmission connector, third protrusions are provided on left and right sides of the first housing; third slots matched with the third protrusions are provided on an inner side of the insulating body, and the insulating body is clamped in the first housing;

the insulating body is a square plastic core.

According to the high-speed data transmission connector, the high-speed data transmission connector further comprises:

a second housing matched with the first housing, the PCB motherboard disposed in the second housing;

a drawstring self-unlocking structure disposed outside the second housing; and a cable having a head end electrically connected to the PCB motherboard.

The invention has two anti-resonance modules that respectively function to prevent generation of resonance by arranging the terminal structure for the high-speed data transmission connector to be a first anti-resonance module comprising a first conducting member disposed on the front-end terminal, and a second anti-resonance module comprising a second conducting member disposed on the rear-end terminal. Moreover, an exterior angle at connection of the front-end terminal and the rear-end terminal of the upper row terminal in the terminal structure is from 55° to 80°, which can function to well protect the terminals during use or package and transportation, so as not to easily break off. Correspondingly, the high-speed data transmission connector comprising the terminal structure has a reliable performance, can realize accurate transmission of 56G high-speed differential signal, and can realize expansion of a differential signal pair according to a baseband width and data capacity of customers. Advantage of structural design ensures functional reliability, manufacture convenience and economy of the high-speed data transmission connector.

DETAILED EMBODIMENTS OF THE INVENTION

Figure 1:
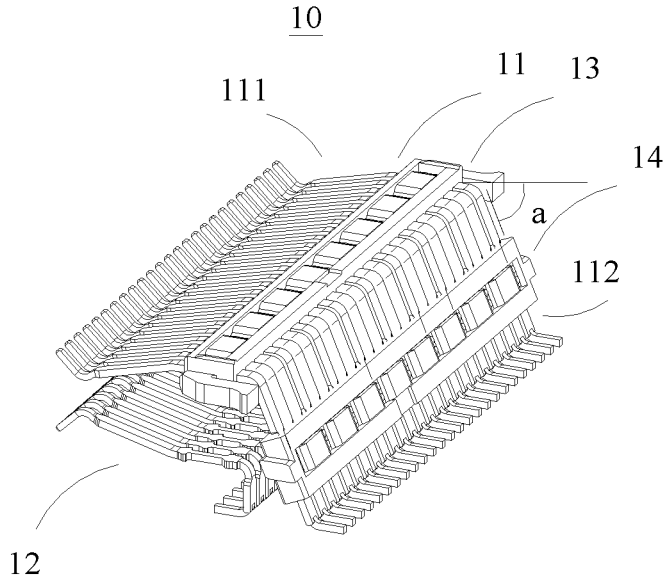
FIG. 1 is a structural diagram of a terminal structure provided in one embodiment of the invention.

To illustrate the objects, technical solutions and advantages of the invention more clearly, the invention is further explained in detail with reference to the accompanying drawings and the embodiments. It shall be understood that references such as "one embodiment", "embodiments", "an exemplary embodiment" and the like in the specification refer to that the embodiment may comprise specific feature, structure or characteristic, but it is unnecessary for each embodiment to comprise such specific feature, structure or characteristic. Moreover, such expressions may not refer to the same embodiment. Further, when the specific feature, structure or characteristic is described with reference to one embodiment, regardless of clear description, it has shown that incorporating such specific feature, structure or characteristic into other embodiments is within the knowledge range of those skilled in the art.

Although specific terms are used in the specification and the subsequent claims to refer to specific components or parts, it shall be understood that the technician or manufacturer can give a different name or term to the same component or part. The specification and the subsequent claims distinguish components or parts from each other by different functions of the components or parts, instead of different names. "Comprise" and "include" in the whole specification and the subsequent claims are open words, and shall be explained as "include but is not limited to". In addition, "connection" herein includes any direct or indirect electrical connection means. Indirect electrical connection means comprises connection through other devices.

It shall be noted that in the invention, orientation or positional relationship indicated by the terms "transverse", "longitudinal", "up", "down", "front", "back", "left", "right", "vertical", "horizontal", "top", "bottom", "in", "out", and the like is the orientation or positional relationship illustrated by the drawings, and is only for the purpose of describing the invention and simplifying the explanation, rather than indicating or suggesting that the referred device or element must have specific orientation, and be constructed and operated in specific orientation, so it shall not be understood as limits to the invention.

Referring to FIGS. 1-14, one embodiment of the invention provides a terminal structure 10 for a high-speed data transmission connector 100, comprising an upper row terminal 11 and a lower row terminal 12 respectively assembled at an upper end and a lower end of an insulating body 30 of the high-speed data transmission connector 100, and electrically connected to a PCB motherboard 50 of the high-speed data transmission connector, the upper row terminal 11 comprising a front-end terminal 111 and a rear-end terminal 112 connected to each other, the terminal structure 10 further comprising:

a first anti-resonance module 13 comprising a first conducting member 131 disposed on the front-end terminal 111; and a second anti-resonance module 14 comprising a second conducting member 141 disposed on the rear-end terminal 112; wherein an exterior angle at connection of the front-end terminal 111 and the rear-end terminal 112 is from 55° to 80°.

In this embodiment, the first anti-resonance module 13 comprising the first conducting member 131 is disposed on the front-end terminal 111, the second anti-resonance module 14 comprising the second conducting member 141 is disposed on the rear-end terminal 112, and the two anti-resonance modules respectively function to prevent the terminal structure 10 from generating resonance when powered on. Specifically, the first anti-resonance module 13 and the second anti-resonance module 14 electrically connect ground pins in the upper row terminal 11 and the lower row terminal 12 to each other through the first conducting member 131 and the second conducting member 141 thereon, which shortens a reflowing path of the product, and changes electromagnetic field distribution around the upper row terminal 11, thereby realizing the object of eliminating resonance. Moreover, the exterior angle at connection of the front-end terminal 111 and the rear-end terminal 112 is from 55° to 80° angle α shown in FIG. 1, i.e., non-vertical. Non-orthogonal design of the front-end terminal 111 and the rear-end terminal 112 and bending design of a small angle R within a material thickness can function to well protect the front-end terminal 111 and the rear-end terminal 112 during assembly or package and transportation, so as not to easily break off.

Since an effective electrical length of the current terminal is equivalent to a wavelength included in the signal, resonance state can occur in the connector. In one embodiment of the invention, the first conducting member 131 and the second conducting member 141 in the two anti-resonance modules couple two ground terminals together, and correct a synthetic resonance frequency of the two ground terminals to provide a preset maximum electrical length associated with a specific resonance frequency. In one embodiment, the first conducting member 131 and the second conducting member 141 function as bridging members, and can couple a plurality of ground terminals. Grounding is configured to shorten the electrical length between discontinuities, and improve the resonance frequency, such that the enhanced frequency is transmitted in the connector without resonance within a working range of the signal connector, thereby improving anti-resonance effect of the terminal structure 10 and the connector 100.

Figure 2:
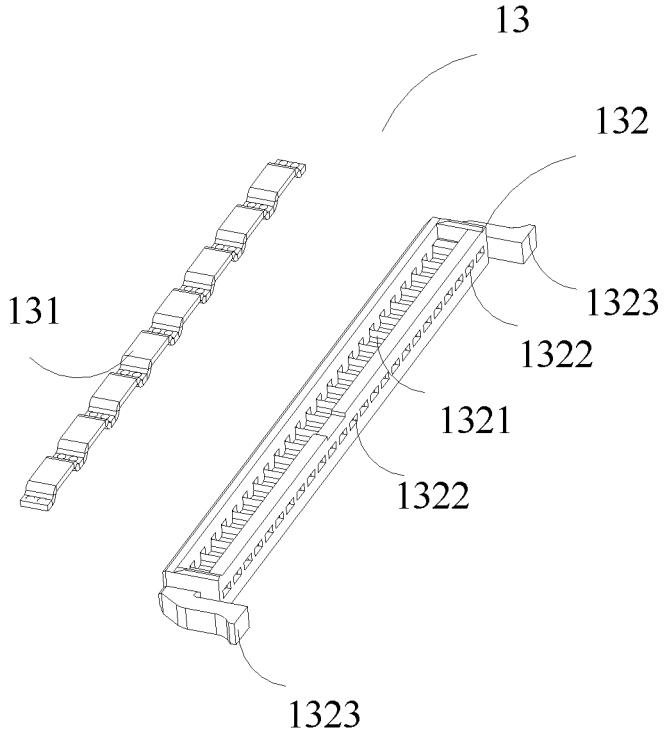
FIG. 2 is a structural diagram of a first anti-resonance module provided in one embodiment of the invention.
Figure 3:
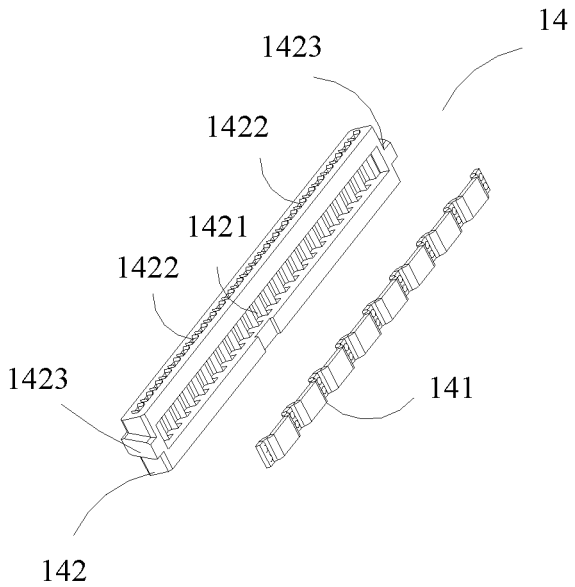
FIG. 3 is a structural diagram of a second anti-resonance module provided in one embodiment of the invention.
Figure 13:
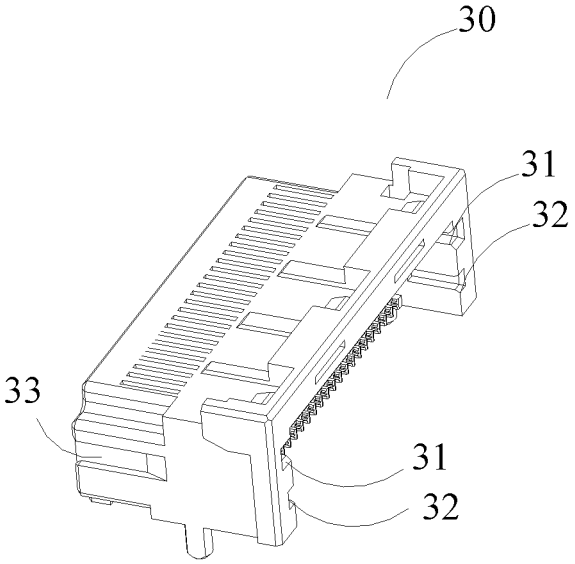
FIG. 13 is a structural diagram of an insulating body of the high-speed data transmission connector provided in one embodiment of the invention.
Figure 14:
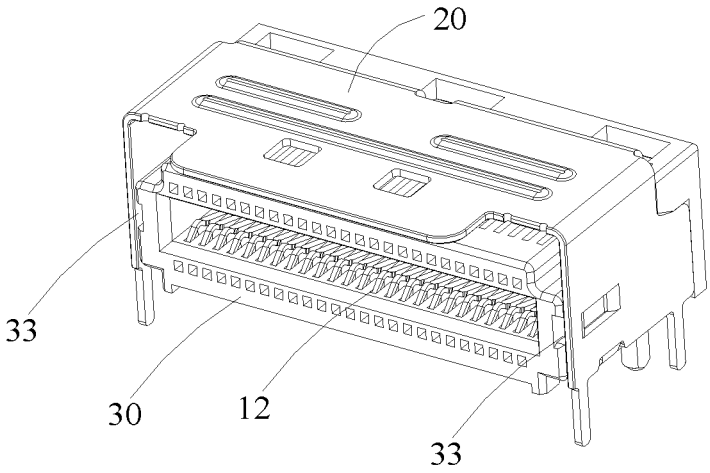
FIG. 14 is an assembled diagram of the terminal structure provided in one embodiment of the invention.

Referring to FIGS. 2, 3 and 13, in one embodiment of the invention, the first anti-resonance module 13 further comprises:

a first insulation embedded block 132 on which a first mounting part 1321 for mounting the first conducting member 131 and a first fixing part 1322 for fixing the first insulation embedded block 132 on the front-end terminal 111 are provided; the first fixing part 1322 for fixing the first conducting member 131 on the front-end terminal 111 through the first insulation embedded block 132. Preferably, the first conducting member 131 is a first metal sheet or a first conducting film; the first mounting part 1321 is a first mounting groove provided on an upper part of the first insulation embedded block 132; the first fixing part 1322 is a plurality of first through holes provided in a middle part of the first insulation embedded block 132 and matched with the front-end terminal 111. The first insulation embedded block 132 may be made of rubber or plastic. The first metal sheet or the first conducting film is fixed in the first mounting groove, and then the front-end terminal 111 passes through the plurality of first through holes of the first insulation embedded block 132, such that the first anti-resonance module 13 is fixed on the front-end terminal 111. The first anti-resonance module 13 can absorb resonance generated by the front-end terminal 111 when the terminal structure 10 is powered on.

The second anti-resonance module 14 further comprises:

a second insulation embedded block 142 on which a second mounting part 1421 for mounting the second conducting member 141 and a second fixing part 1422 for fixing the second insulation embedded block 142 on the rear-end terminal 112 are provided; the second fixing part 1422 for fixing the second conducting member 141 on the rear-end terminal 112 through the second insulation embedded block 142. Preferably, the second conducting member 141 is a second metal sheet or a second conducting film; the second mounting part 1421 is a second mounting groove provided on an upper part of the second insulation embedded block 142; the second fixing part 1422 is a plurality of second through holes provided in a middle part of the second insulation embedded block 142 and matched with the rear-end terminal 112. The second metal sheet or the second conducting film is fixed in the second mounting groove. The rear-end terminal 112 passes through the plurality of second through holes of the second insulation embedded block 142, such that the second anti-resonance module 14 is fixed on the rear-end terminal 112. The second anti-resonance module 14 can absorb resonance generated by the rear-end terminal 112 when the terminal structure 10 is powered on. The first anti-resonance module 13 and the second anti-resonance module 14 on the front-end and rear-end terminals of the terminal structure 10 can well absorb resonance generated when the terminal structure 10 is powered on, and have a simple structure.

Figure 4:
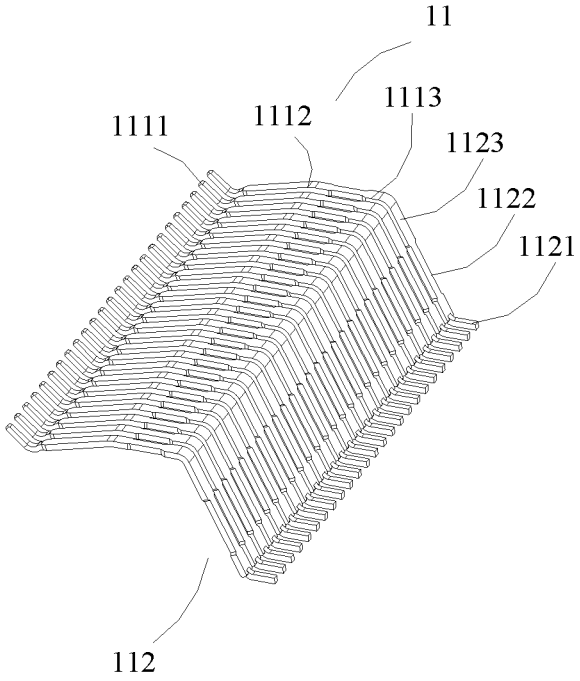
FIG. 4 is a structural diagram of an upper row terminal in the terminal structure provided in one embodiment of the invention.
Figure 5:
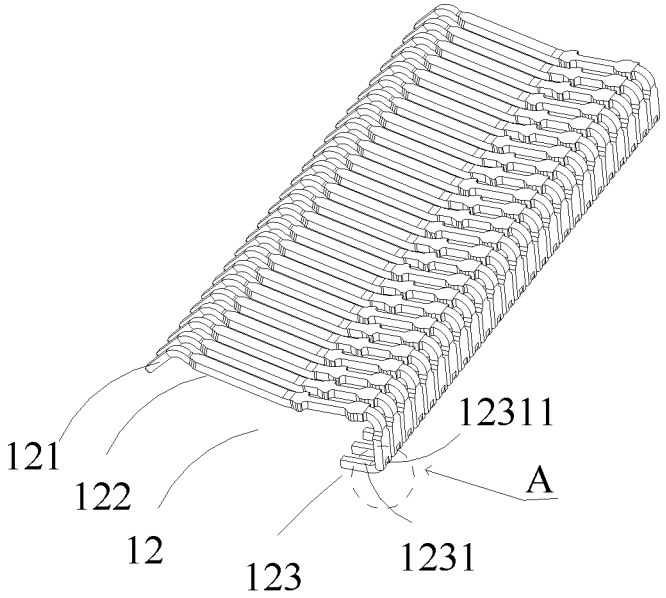
FIG. 5 is a structural diagram of a lower row terminal in the terminal structure provided in one embodiment of the invention.
Figure 6:
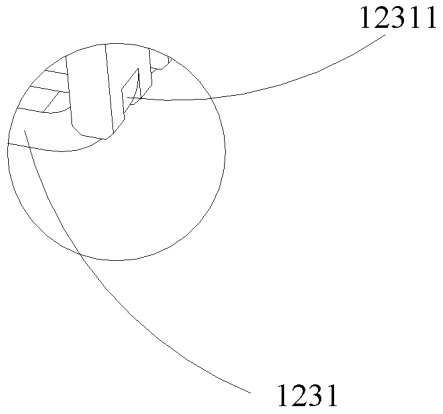
FIG. 6 is an enlarged diagram of A in FIG. 5.

Referring to FIGS. 4-6, in one embodiment of the invention, the front-end terminal 111 and the rear-end terminal 112 both comprise a first rear side part (1111, 1121), a first middle part (1112, 1122) and a first head-end part (1113, 1123), wherein the first head-end part 1113 of the front-end terminal 111 is connected to the first head-end part 1123 of the rear-end terminal 112; an exterior angle at connection thereof is from 55° to 80°. The first insulation embedded block 132 is fixed on the first head-end part 1113 of the front-end terminal 111; the second insulation embedded block 142 is fixed on the first middle part 1122 of the rear-end terminal 112. Accordingly, fixed positions of the first insulation embedded block 132 and the second insulation embedded block 142 being spaced apart by a certain distance, and substantially at a middle position of the front-end and rear-end terminals enable the first anti-resonance module 13 and the second anti-resonance module 14 to work together to better function to prevent resonance. Preferably, the first insulation embedded block 132 and the second insulation embedded block 142 are molded with plastic inserts of the upper row terminal 11; the first rear side part 1111 of the front-end terminal 111 is electrically connected to the PCB motherboard 50. Since the first insulation embedded block 132 and the second insulation embedded block 142 are molded with plastic inserts of the upper row terminal 11, it facilitates mounting the terminal structure 10 to the connector 100.

Referring to FIGS. 5, 6, 8 and 9, in one embodiment of the invention, the lower row terminal 12 comprise a second rear side part 121, a second middle part 122 and a second head-end part 123; the second head-end part 123 is bent in a "C" shape, and Surface Mounted Technology (SMT) solder legs 1231 are provided at bottom of a "C"-shaped bending region of the second head-end part 123. The lower row terminal 12 is bent in a "C" shape to produce the SMT solder legs, and is assembled into the connector 100 in a direct inserting way, instead of an insertion molding way, thereby facilitating mounting of the terminal structure 10 while not easily generating the phenomenon of running slider. Moreover, the bending region of the solder legs 1231 has a pierced structure 12311; the second rear side part 121 of the lower row terminal 12 is electrically connected to the PCB motherboard 50. Referring to FIG. 5, the solder legs 1231 are bent by double ninety degrees simultaneously, and use a special material connecting way to facilitate processing. Referring to FIG. 6, the solder legs 1231 use a pierced way to facilitate continuity of punching. Specifically, the strip is bent when piercing the frame to facilitate bending and selective electrogilding, and protects the solder legs 1231 to facilitate package and avoid the lower row terminal 12 in the terminal structure 10 from being pressed and damaged.

Figure 7:
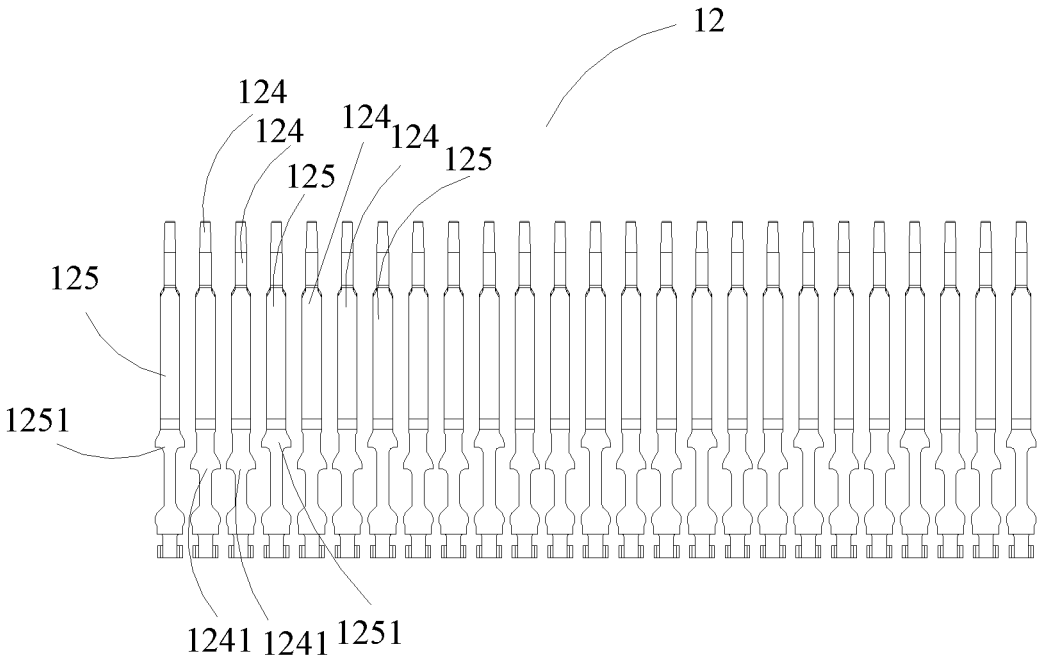
FIG. 7 is a structural diagram of a lower row terminal in a terminal structure provided in one embodiment of the invention.
Figure 8:
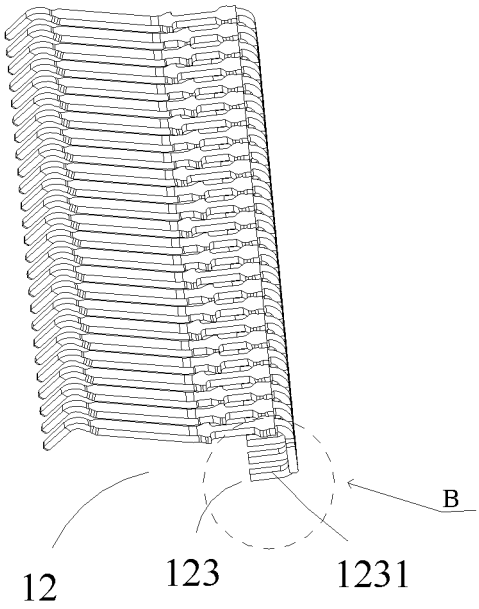
FIG. 8 is a structural diagram of a lower row terminal in a terminal structure provided in one embodiment of the invention.
Figure 9:
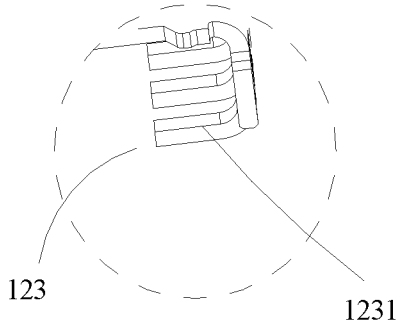
FIG. 9 is an enlarged diagram of B in FIG. 8.

Referring to FIG. 7, in one embodiment of the invention, the lower row terminal 12 is provided with a plurality of hangnail structures. The difference is that the current terminal is often an advance side by side structure, and the plurality of hangnail structures of the lower row terminal 12 are arranged as an impedance control design of effective abrupt interfaces. Specifically, in one embodiment of the invention, the lower row terminal 12 comprises a first signal transmission terminal 124 on which a first hangnail structure 1241 is provided, and a second signal transmission terminal 125 on which a second hangnail structure 1251 is provided, the first hangnail structure 1241 and the second hangnail structure alternated with each other. The first signal transmission terminal 124 is a differential signal transmission terminal; the second signal transmission terminal 125 is a ground signal transmission terminal; the ground signal transmission terminal is spaced apart from the differential signal transmission terminal. However, the first signal transmission terminal and the second signal transmission terminal are relative. In other embodiments of the present invention, the ground signal transmission terminal may also be named the first signal transmission terminal; and the differential signal transmission terminal may be named the second signal transmission terminal.

Referring to FIGS. 10-14, one embodiment of the invention further provides a high-speed data transmission connector 100, comprising a first housing 20, an insulating body 30 and a terminal structure 10 assembled within the insulating body 30, wherein the terminal structure 10 further comprises:

a first anti-resonance module 13 comprising a first conducting member 131 disposed on the front-end terminal 111; and a second anti-resonance module 14 comprising a second conducting member 141 disposed on the rear-end terminal 112;

wherein an exterior angle at connection of the front-end terminal 111 and the rear-end terminal 112 is from 55° to 80°.

In this embodiment, the first anti-resonance module 13 and the second anti-resonance module 14 are disposed respectively on the front-end terminal 111 and the rear-end terminal 112 of the terminal structure 10, and function to prevent resonance. Moreover, the exterior angle at connection of the front-end terminal 111 and the rear-end terminal 112 is from 55° to 80°, and non-orthogonal design of the front-end terminal 111 and the rear-end terminal 112 and bending design of a small angle R within a material thickness can function to well protect the front-end terminal 111 and the rear-end terminal 112 during use or package and transportation, so as not to easily break off.

Since the first anti-resonance module 13 and the second anti-resonance module 14 have good anti-resonance effect, the high-speed data transmission connector 100 provided in the invention cam realize accurate transmission of the high-speed 56G differential signal. Moreover, the high-speed data transmission connector 100 can realize expansion of differential signal pair, such as, 74 pin, 100 pin, and the like, or expansion of a plurality of port connections according to a baseband width and data capacity of customers. Practically, differential loss and crosstalk index of transmission speed 56G conform to the standard PCI-Express (PCI-E) 4.0 through simulation tests.

Referring to FIGS. 2 and 3, in one embodiment of the invention, the first anti-resonance module 13 further comprises:

a first insulation embedded block 132 on which a first mounting part 1321 for mounting the first conducting member 131 and a first fixing part 1322 for fixing the first insulation embedded block 132 on the front-end terminal 111 are provided. The first conducting member 131 is fixed on the first insulation embedded block 132 through the first mounting part 1321 of the first insulation embedded block 132, and the first insulation embedded block 132 is fixed on the front-end terminal 111 through the first fixing part 1322.

The second anti-resonance module 14 further comprises:

a second insulation embedded block 142 on which a second mounting part 1421 for mounting the second conducting member 141 and a second fixing part 1422 for fixing the second insulation embedded block 142 on the rear-end terminal 112 are provided. The second conducting member 141 is mounted on the second insulation embedded block 142 through the second mounting part 1421, and the second insulation embedded block 142 is fixed on the rear-end terminal 112 through the second fixing part 1422.

Preferably, the first conducting member 131 is a first metal sheet or a first conducting film; the first mounting part 1321 is a first mounting groove provided on an upper part of the first insulation embedded block 132; the first fixing part 1322 is a plurality of first through holes provided in a middle part of the first insulation embedded block 132 and matched with the front-end terminal 111. After the assembled connector 100 is conductive, the terminal structure 10 is conductive, and the first anti-resonance module 13 can absorb resonance generated by the front-end terminal 111 when the terminal structure 10 is powered on.

The second conducting member 141 is a second metal sheet or a second conducting film; the second mounting part 1421 is a second mounting groove provided on an upper part of the second insulation embedded block 142; the second fixing part 1422 is a plurality of second through holes provided in a middle part of the second insulation embedded block 142 and matched with the rear-end terminal 112. After the assembled connector 100 is conductive, the terminal structure 10 is conductive, and the second anti-resonance module 14 can absorb resonance generated by the rear-end terminal 112 when the terminal structure 10 is powered on.

Referring to FIGS. 4-6, in one embodiment of the invention, the front-end terminal 111 and the rear-end terminal 112 both comprise a first rear side part (1111, 1121), a first middle part (1112, 1122) and a first head-end part (1113, 1123), wherein the first head-end part 1113 of the front-end terminal 111 is connected to the first head-end part 1123 of the rear-end terminal 112; the first insulation embedded block 132 is fixed on the first head-end part 1113 of the front-end terminal 111; the second insulation embedded block 142 is fixed on the first middle part 1122 of the rear-end terminal 112. The first insulation embedded block 132 and the second insulation embedded block 142 are molded with plastic inserts of the upper row terminal 11; the first rear side part 1111 of the front-end terminal 111 is electrically connected to the PCB motherboard 50. Since the first insulation embedded block 132 and the second insulation embedded block 142 are molded with plastic inserts of the upper row terminal 11, generally, insertion molding facilitates mounting the terminal structure 10 to the connector 100. The first insulation embedded block 132 and the second insulation embedded block 142 are made of plastic.

Referring to FIGS. 5, 6, 8 and 9, in one embodiment of the invention, the lower row terminal 12 comprise a second rear side part 121, a second middle part 122 and a second head-end part 123; the second head-end part 123 is bent in a "C" shape, and Surface Mounted Technology (SMT) solder legs 1231 are provided at bottom of a "C"-shaped bending region of the second head-end part 123. The lower row terminal 12 is bent in a "C" shape to produce the SMT solder legs, and is assembled into the connector 100 in a direct inserting way, instead of an insertion molding way. As compared to assembling way of insertion molding of the lower row terminal, and then entirely assembled into the insulating body of the current connector, it facilitates overall mounting of the terminal structure 10. Moreover, the bending region of the solder legs 1231 has a pierced structure 12311; the second rear side part 121 of the lower row terminal 12 is electrically connected to the PCB motherboard 50. Referring to FIG. 5, the solder legs 1231 are bent by double ninety degrees simultaneously, and use a special material connecting way to facilitate processing. Referring to FIG. 6, the solder legs 1231 use a pierced way to facilitate continuity of punching. Specifically, the strip is bent when piercing the frame to facilitate bending and selective electrogilding, and protects the solder legs 1231 to facilitate package and avoid the lower row terminal 12 in the terminal structure 10 from being pressed and damaged. As compared to bending ninety degrees firstly, then bending ninety degrees after electroplating of the current solder legs, the solder legs have the above advantages.

Referring to FIG. 7, in one embodiment of the invention, the lower row terminal 12 is provided with a plurality of hangnail structures. The difference is that the current terminal is often an advance side by side structure, and the plurality of hangnail structures of the lower row terminal 12 are arranged as an impedance control design of effective abrupt interfaces. Specifically, in one embodiment of the invention, the lower row terminal 12 comprises a first signal transmission terminal 124 on which a first hangnail structure 1241 is provided, and a second signal transmission terminal 125 on which a second hangnail structure 1251 is provided, the first hangnail structure 1241 and the second hangnail structure alternated with each other. The first signal transmission terminal 124 is a differential signal transmission terminal, but the first signal transmission terminal 124 is differential signal transmission without devices; the second signal transmission terminal 125 is a ground signal transmission terminal; the ground signal transmission terminal is spaced apart from the differential signal transmission terminal. However, the first signal transmission terminal and the second signal transmission terminal are relative. In other embodiments of the present invention, the ground signal transmission terminal may also be named the first signal transmission terminal; and the differential signal transmission terminal may be named the second signal transmission terminal.

Referring to FIGS. 2, 3 and 13, in one embodiment of the invention, first protrusions 1323 are provided on left and right sides of the first insulation embedded block 132, first slots 31 matched with the first protrusions 1323 are provided on an inner side of the insulating body 30, and the first insulation embedded block 132 is clamped in the first slots 31 through the first protrusions 1323, such that the first anti-resonance module 13 can be fixed on the insulating body 30.

Second protrusions 1423 are provided on left and right sides of the second insulation embedded block 142, second slots 32 matched with the second protrusions 1423 are provided on the inner side of the insulating body 30, and the second insulation embedded block 142 is clamped in the second slots 32 through the second protrusions 1423. Accordingly, the second anti-resonance module 14 can be fixed on the insulating body 30. The first insulation embedded block 132 and the second insulation embedded block 142 have preset spaces movable in the same direction after being clamped in the first slots 31 and the second slots 32, respectively. The first anti-resonance module 13 is positioned by plastic cantilever upside-down hanging, and the second anti-resonance module 14 is positioned up and down in a slot of the insulating body 30 to ensure consistence of forward and backward directions without limiting a degree of freedom of movement.

Referring to FIGS. 2 and 3, in one embodiment of the invention, the first protrusions 1323 are a cantilever upside-down hanging structure for clamping the first anti-resonance module 13 within the first slots 31 of the insulating body 30. The preset spaces movable in the same direction move up and down for a preset distance along a longitudinal direction of the first slots 31.

Referring to FIGS. 11-14, in one embodiment of the invention, third protrusions 21 are provided on left and right sides of the first housing 20; third slots 33 matched with the third protrusions 21 are provided on an outside of the insulating body 30, and the insulating body 30 is clamped in the first housing 20; the insulating body 30 is a square plastic core. The first housing 20 limits the degree of freedom of up and down rotation of the housing by piercing a reverse convex clamping structure on a lateral surface, so as to improve reliability of the high-speed data transmission connector 100 in use.

Figure 10:
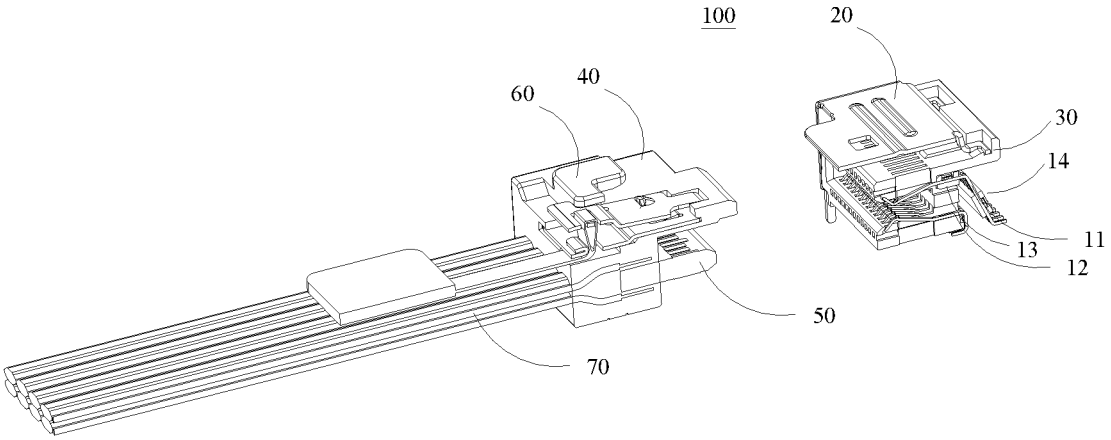
FIG. 10 is a schematic diagram of an assembled structure of a high-speed data transmission connector provided in one embodiment of the invention.
Figure 11:
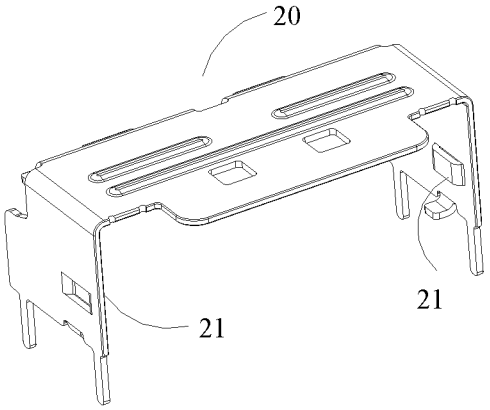
FIG. 11 is a structural diagram of a first housing of the high-speed data transmission connector provided in one embodiment of the invention.
Figure 12:
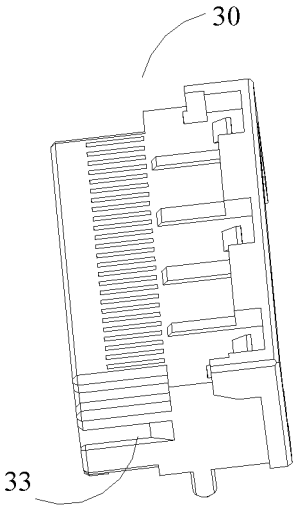
FIG. 12 is a structural diagram of an insulating body of the high-speed data transmission connector provided in one embodiment of the invention.

Referring to FIG. 10, in one embodiment of the invention, the high-speed data transmission connector 100 further comprises:

a second housing 40 matched with the first housing 20, the PCB motherboard 50 disposed in the second housing 40;

a drawstring self-unlocking structure 60 disposed outside the second housing 40; and a cable 70 having a head end electrically connected to the PCB motherboard 50.

In this embodiment, self-locking is realized by pairing of a self-locking frame and a corresponding plug with cable, and the plug is unlocked through the drawstring self-unlocking structure 60 having a drawstring and an unlocking elastic arm structure.

As can be seen, insertion molding of the upper row terminal 11 of the high-speed data transmission connector 100 provided in the invention is entirely inserted, and the lower row terminal 12 is directly inserted to assemble and fix with the plastic body. The upper row terminal 11 and the lower row terminal 12 are in contact connection with the PCB of a tongue of the plug of the interface through the elastic cantilever. The upper row terminal 11 and the lower row terminal 12 are connected to the PCB motherboard 50 through SMT soldering. The problems that the current products must use insertion molding technology, and the insertion molding has running slider in the lower row terminal, so it is not suitable for efficient and rapid molding of vertical injection molding machines; the problem that currently, strip connection of the terminal does not facilitate continuous and selective electrogilding; the problem that currently, placement and transportation of the insertion molding easily cause deformation of the terminal; and the problem that currently, the insertion molding must be bent twice in assembly, causing poor coplanarity of SMT solder tails are solved in the prior art.

The high-speed data transmission connector 100 provided in the embodiments of the invention can realize accurate transmission of 56G high-speed differential signal, and can realize expansion of differential signal pair, such as, 74 pin, 100 pin, and the like, or expansion of a plurality of port connections according to a baseband width and data capacity of customers. Practically, in simulation tests, differential loss and crosstalk index of transmission speed 56G conform to the standard PCI-E 4.0, thereby ensuring high-speed, reliable and stable connection between a host and an extension or a function module, and advantage of structural design ensures functional reliability, manufacture convenience and economy of the high-speed data transmission connector. Of course, other high-speed signal transmission is also possible.

In conclusion, the invention has two anti-resonance modules that respectively function to prevent generation of resonance by arranging the terminal structure for the high-speed data transmission connector to be a first anti-resonance module comprising a first conducting member disposed on the front-end terminal, and a second anti-resonance module comprising a second conducting member disposed on the rear-end terminal. Moreover, an exterior angle at connection of the front-end terminal and the rear-end terminal of the upper row terminal in the terminal structure is from 55° to 80°, which can function to well protect the terminals during use or package and transportation, so as not to easily break off. Correspondingly, the high-speed data transmission connector comprising the terminal structure has a reliable performance, can realize accurate transmission of 56G high-speed differential signal, and can realize expansion of difference signal pair according to a baseband width and data capacity of customers. Advantage of structural design ensures functional reliability, manufacture convenience and economy of the high-speed data transmission connector.

Of course, the invention also may have various other embodiments, and those skilled in the art shall make various corresponding modifications and variations according to the invention without departing from spirit and essence of the invention, but these corresponding modifications and variations shall belong to the scope protected by the appended claims of the invention.

What is claimed is:

1. A terminal structure for a high-speed data transmission connector, comprising an upper row terminal and a lower row terminal which respectively assembled at an upper end and a lower end of an insulating body of the high-speed data transmission connector, and electrically connected to a PCB motherboard of the high-speed data transmission connector, the upper row terminal comprising a front-end terminal and a rear-end terminal connected to each other, the terminal structure further comprising:

a first anti-resonance module comprising a first conducting member disposed on the front-end terminal; and a second anti-resonance module comprising a second conducting member disposed on the rear-end terminal;

wherein an exterior angle at connection of the front-end terminal and the rear-end terminal is from 55° to 80°.

2. The terminal structure according to claim 1, wherein the first anti-resonance module further comprises:

a first insulation embedded block on which a first mounting part for mounting the first conducting member and a first fixing part for fixing the first insulation embedded block on the front-end terminal are provided;

the second anti-resonance module further comprises:

a second insulation embedded block on which a second mounting part for mounting the second conducting member and a second fixing part for fixing the second insulation embedded block on the rear-end terminal are provided.

3. The terminal structure according to claim 2, wherein the first conducting member is a first metal sheet or a first conducting film; the first mounting part is a first mounting groove provided on an upper part of the first insulation embedded block; the first fixing part is a plurality of first through holes provided in a middle part of the first insulation embedded block and matched with the front-end terminal;

the second conducting member is a second metal sheet or a second conducting film; the second mounting part is a second mounting groove provided on an upper part of the second insulation embedded block; the second fixing part is a plurality of second through holes provided in a middle part of the second insulation embedded block and matched with the rear-end terminal.

4. The terminal structure according to claim 2, wherein the front-end terminal and the rear-end terminal both comprise a first rear side part, a first middle part and a first head-end part, wherein the first head-end part of the front-end terminal is connected to the first head-end part of the rear-end terminal;

the first insulation embedded block is fixed on the first head-end part of the front-end terminal; the second insulation embedded block is fixed on the first middle part of the rear-end terminal.

5. The terminal structure according to claim 4, wherein the first insulation embedded block and the second insulation embedded block are molded with plastic inserts of the upper row terminal;

the first rear side part of the front-end terminal is electrically connected to the PCB motherboard.

6. The terminal structure according to claim 1, wherein the lower row terminal comprises a second rear side part, a second middle part and a second head-end part; the second head-end part is bent in a "C" shape, and Surface Mounted Technology (SMT) solder legs are provided at bottom of a "C"-shaped bending region of the second head-end part.

7. The terminal structure according to claim 6, wherein the bending region of the solder legs has a pierced structure;

the second rear side part of the lower row terminal is electrically connected to the PCB motherboard.

8. The terminal structure according to claim 1, wherein the lower row terminal is provided with a plurality of hangnail structures.

9. The terminal structure according to claim 8, wherein the lower row terminal comprises a first signal transmission terminal on which a first hangnail structure is provided, and a second signal transmission terminal on which a second hangnail structure is provided, the first hangnail structure and the second hangnail structure are alternated with each other.

10. The terminal structure according to claim 9, wherein the first signal transmission terminal is a ground signal transmission terminal; the second signal transmission terminal is a differential signal transmission terminal;

the ground signal transmission terminal is spaced apart from the differential signal transmission terminal.

11. A high-speed data transmission connector, comprising a first housing, an insulating body, a PCB motherboard and a terminal structure assembled within the insulating body, the terminal structure comprising an upper row terminal and a lower row terminal, the upper row terminal comprising a front-end terminal and a rear-end terminal connected to each other, wherein the terminal structure further comprises:

a first anti-resonance module comprising a first conducting member disposed on the front-end terminal; and a second anti-resonance module comprising a second conducting member disposed on the rear-end terminal;

wherein an exterior angle at connection of the front-end terminal and the rear-end terminal is from 55° to 80°.

12. The high-speed data transmission connector according to claim 11, wherein the first anti-resonance module further comprises:

a first insulation embedded block on which a first mounting part for mounting the first conducting member and a first fixing part for fixing the first insulation embedded block on the front-end terminal are provided;

the second anti-resonance module further comprises:

a second insulation embedded block on which a second mounting part for mounting the second conducting member and a second fixing part for fixing the second insulation embedded block on the rear-end terminal are provided.

13. The high-speed data transmission connector according to claim 12, wherein the first conducting member is a first metal sheet or a first conducting film; the first mounting part is a first mounting groove provided on an upper part of the first insulation embedded block; the first fixing part is a plurality of first through holes provided in a middle part of the first insulation embedded block and matched with the front-end terminal;

the second conducting member is a second metal sheet or a second conducting film; the second mounting part is a second mounting groove provided on an upper part of the second insulation embedded block; the second fixing part is a plurality of second through holes provided in a middle part of the second insulation embedded block and matched with the rear-end terminal.

14. The high-speed data transmission connector according to claim 12, wherein the front-end terminal and the rear-end terminal both comprise a first rear side part, a first middle part and a first head-end part, wherein the first head-end part of the front-end terminal is connected to the first head-end part of the rear-end terminal;

the first insulation embedded block is fixed on the first head-end part of the front-end terminal; the second insulation embedded block is fixed on the first middle part of the rear-end terminal.

15. The high-speed data transmission connector according to claim 14, wherein the first insulation embedded block and the second insulation embedded block are molded with plastic inserts of the upper row terminal;

the first rear side part of the front-end terminal is electrically connected to the motherboard.

16. The high-speed data transmission connector according to claim 11, wherein the lower row terminal comprises a second rear side part, a second middle part and a second head-end part; the second head-end part is bent in a "C" shape, and Surface Mounted Technology (SMT) solder legs are provided at bottom of a "C"-shaped bending region of the second head-end part.

17. The high-speed data transmission connector according to claim 16, wherein the bending region of the solder legs has a pierced structure;

the second rear side part of the lower row terminal is electrically connected to the PCB motherboard.

18. The high-speed data transmission connector according to claim 11, wherein the lower row terminal is provided with a plurality of hangnail structures.

19. The high-speed data transmission connector according to claim 18, wherein the lower row terminal comprises a first signal transmission terminal on which a first hangnail structure is provided, and a second signal transmission terminal on which a second hangnail structure is provided, the first hangnail structure and the second hangnail structure are alternated with each other.

20. The high-speed data transmission connector according to claim 19, wherein the first signal transmission terminal is a ground signal transmission terminal; the second signal transmission terminal is a differential signal transmission terminal;

the ground signal transmission terminal is spaced apart from the differential signal transmission terminal.

21. The high-speed data transmission connector according to claim 12, wherein first protrusions are provided on left and right sides of the first insulation embedded block, first slots matched with the first protrusions are provided on an inner side of the insulating body, and the first insulation embedded block is clamped in the first slots through the first protrusions;

second protrusions are provided on left and right sides of the second insulation embedded block, second slots matched with the second protrusions are provided on the inner side of the insulating body, and the second insulation embedded block is clamped in the second slots through the second protrusions.

22. The high-speed data transmission connector according to claim 21, wherein the first insulation embedded block and the second insulation embedded block have preset spaces movable in the same direction after being clamped in the first slots and the second slots, respectively.

23. The high-speed data transmission connector according to claim 22, wherein the first protrusions are a cantilever upside-down hanging structure, and the preset spaces movable in the same direction move up and down for a preset distance along a longitudinal direction of the first slots.

24. The high-speed data transmission connector according to claim 11, wherein third protrusions are provided on left and right sides of the first housing; third slots matched with the third protrusions are provided on an inner side of the insulating body, and the insulating body is clamped in the first housing;

the insulating body is a square plastic core.

25. The high-speed data transmission connector according to claim 11, wherein the high-speed data transmission connector further comprises:

a second housing matched with the first housing, the PCB motherboard disposed in the second housing;

a drawstring self-unlocking structure disposed outside the second housing; and a cable having a head end electrically connected to the PCB motherboard.

* * * * *